US005139446A

United States Patent [19]

Costello et al.

[11] Patent Number: 5,139,446

[45] Date of Patent: Aug. 18, 1992

[54] ELECTRICAL CONNECTOR ASSEMBLY

[75] Inventors: Brian P. Costello, Harrisburg; John W. Kaufman, Hershey, both of Pa.

[73] Assignee: AMP Incorporated, Harrisburg, Pa.

[21] Appl. No.: 785,388

[22] Filed: Oct. 30, 1991

[51] Int. Cl.[5] ..... H01R 13/42

[52] U.S. Cl. ..... 439/751; 439/82

[58] Field of Search ..... 439/2, 89, 751

[56] References Cited

U.S. PATENT DOCUMENTS

| | | | |
|---|---|---|---|
| 4,186,982 | 2/1980 | Cobaugh et al. | 339/17 |
| 4,553,322 | 11/1985 | Cappos et al. | 29/739 |
| 4,743,208 | 5/1988 | Weisenburger | 439/398 |
| 4,857,018 | 8/1989 | Pickles | 439/751 |
| 4,904,212 | 2/1990 | Durbin et al. | 439/751 |

OTHER PUBLICATIONS

"Improved Serpentine Connector Assembly", IBM Tech. Discl. Bul. vol. 31, No. 7, Dec. 1988, pp. 425–426.

*Primary Examiner*—Eugene F. Desmond

*Attorney, Agent, or Firm*—Katherine A. Nelson

[57] ABSTRACT

An electrical connector assembly 10 includes a housing 12 having a plurality of terminal members 40 disposed within configured terminal-receiving passageways 82 thereof. Each terminal member 40 includes first and second contact portions 42, 62 and a body portion 46 having retaining means 52 for holding the terminal member 40 within the housing passageway 82 and a plurality of push means horizontally and vertically staggered about the longitudinal axis of the terminal member 40 and adapted to cooperate with corresponding push ledges 86, 88, 90 within the passageway 82. The push means includes a latch 54 extending outwardly from a first side 49 of the body portion 46 and first and second pairs of formed tabs 56, 58 extending from opposed second and third sides 50, 51 of the body portion 46 at first, second and third axially selected locations respectively. The leading ends 57 of the first pair of tabs 56 substantially abut each other proximate to and spaced outwardly from a fourth side 48 of the body portion 46, and a second pair of tabs 58 face in the same direction as the first body side 49 with the leading ends 59 thereof spaced from one another. When axial insertion force is applied to the connector housing 12, the plurality of staggered terminal push means cooperate with the corresponding passageway push surfaces to distribute the force around the terminal members 40 such that the terminal members 40 are inserted into the board 92 without the need of an insertion tool that applies force directly to individual terminal members 40.

12 Claims, 6 Drawing Sheets

ELECTRICAL CONNECTOR ASSEMBLY

FIELD OF THE INVENTION

The present invention relates to an electrical connector assembly and, more particularly, an electrical connector assembly having a plurality of compliant pin terminals requiring a high level of force for insertion thereof into respective holes of a circuit boards.

BACKGROUND OF THE INVENTION

It is often desirable to electrically interconnect contact terminals in an electrical connector assembly to circuits on a circuit board or to connector mounted from an opposite side of the circuit board by means other than using solder. One such means is the use of compliant pin terminals such as those disclosed in U.S. Pat. No. 4,186,982. This type of compliant section is typically formed in terminals having square posts formed from stock having a thickness of about 0.025 in. (0.63 mm) or greater. Insertion of such terminals into a circuit board, however, requires the application of a sufficient amount of axial force to overcome the normal force between the split sections of the compliant pin in a plated through-hole thereby allowing the compliant pin portions to move through the plated through-hole and establish electrical contact therewith. Typically compliant pin terminals, such as those described, require approximately 30–40 pounds of axial force per terminal to insert the terminal into the circuit board. Owing to the high insertion force, compliant pin terminals have generally been limited to square post terminals that are sufficiently strong to withstand the level of force required to insert the terminal into the board. The compliant pin terminals of this type have a retention force of about 15–20 pounds per terminal In some applications, however, it is desirable that the electrical terminals at the mating face of the connector be made of thinner stock material than that required for the compliant pin portion. Furthermore, the configuration of the contact portions at the mating face may not be adapted to be engaged by insertion tools nor capable of sustaining substantial levels of force required for insertion of the terminals into their respective housings or into circuit boards where the terminal members meet substantial resistance.

The elimination of solder is particularly desirable when a connector is going to be used in a "stacking" arrangement. When stacking connectors, the terminal members include connecting portions that are of sufficient length to extend through a circuit board and into complimentary terminal members of a connector disposed on the opposite side of the circuit board. In such applications, the compliant pin portion must exert sufficient normal force to retain the first connector on the board even while force is being applied from the underside of the board by the mating connector. Generally each mating terminal will exert a force of about 6–8 ounces as the complementary connector is mated from the underside of the board.

U.S. Pat. No. 4,857,018 discloses a compliant pin that can be stamped and formed from flat stock material and can be formed from stock thicknesses of 0.015 in. (0.38 mm) or less. A typical insertion force for this type of compliant pin is about 20 pounds per terminal. This type of compliant pin terminals have a retention force of 5–7 pounds per terminal. While the thin stock is desirable in many instances for stamping and forming mating contact portions, the retention force of the thinner stock material is not suitable for most non-solder applications such as stacking, I/O connectors or the like. Furthermore, the current accepted industry standard requires the use of terminals having square posts formed from 0.025 in. (0.63 mm) for solderless interconnections such as described above. The thin stock compliant pin terminals generally are not used in applications where another interconnection is to be made to the leading end of the compliant pin portion, such as for example, mating a connector to the ends of the terminals from the opposite side of the circuit board. It is desirable, therefore, to provide a terminal member that may be stamped and formed while concomitantly having the stiffer compliant pin portion of the thicker stock material.

One way of mounting connectors having the thick stock compliant pin portion to circuit boards is by use of a tool having respective push pins that enter into each of the terminal containing passageways and exert force against a portion of the terminal to push the terminal post portions into the respective holes of the circuit board. This method is disclosed, for example, in U.S. Pat. No. 4,553,322. In order to accommodate the push pins of the tool, the contacts and housings must be configured to receive the tools. As the contact density of the connectors becomes greater, it is desirable to have a means for inserting the stiff compliant pin terminals without the need for tools to enter the respective terminal receiving passageways.

SUMMARY OF THE INVENTION

Accordingly, the present invention is directed to an electrical terminal member and an electrical connector assembly that alleviates the problems and deficiencies associated with prior art. The terminal member of the present invention includes first and second contact portions and an intermediate body portion extending therebetween. The first contact portion is adapted for mating with a complimentary terminal member, the second contact portion includes a compliant section adapted to be received in a through-hole of a circuit board and the body portion includes a plurality of push surfaces adapted to cooperate with corresponding pushing ledges within a connector housing to insert the terminal members into a circuit board. The push surfaces of the body portion are staggered both horizontally and vertically about the longitudinal axis of the terminal member. The push surfaces include a latch extending outwardly from a first side of the body at a first selected axial location, a first pair of outwardly directed tabs extending from opposed side edges of the body portion at a second axially selected location and a second pair of outwardly directed tabs extending from opposed side edges of the body portion at a third selected axial location. The first pair of tabs are formed toward each other such that the leading ends thereof substantially abut each other proximate to and spaced outwardly from the fourth side of the body section. The second pair of outwardly directed tabs are formed to face the same direction as the first side of the body portion and the leading ends thereof are spaced from one another. Upon disposing the terminal members within respective terminal-receiving passageways of a connector housing and mounting the assembly to the circuit board, force may be applied directly to the mating face of the connector housing whereby the plurality of staggered push surfaces of the terminal members cooperate with corresponding ledges within the terminal-receiving passageways of the housing to distribute the insertion force about the terminal members and push the terminal members and the respective compliant sections to move into the corresponding through-holes into the circuit board without the need of an insertion tool to apply force directly to the individual terminal members.

In the preferred embodiment the first connecting portion of the terminal member is formed from a thinner layer of material than that of the second connecting portion. The terminal member is preferably stamped and formed from stock that has been skived, as known in the art, to provide a thinner portion of stock extending across a selected width of the stock. In accordance with the present invention, the thinner portion is used to form the first connecting end body sections of the terminal member and the thicker portion is used for the compliant pin portion.

It is an object of the present invention to provide a contact terminal having a compliant pin portion with a substantial retention force and an electrical connector assembly that may be mounted to a circuit board by "flat rock" mounting means.

It is a further object of the invention to provide an electrical connector assembly that is suitable for stacking without the need for solder.

It is also an object of the invention to provide a means for inserting stiff compliant pin terminals in a high density connector without the need for tools to enter the respective terminal receiving passageways.

Another object of the invention is to provide a terminal member that may be used in connectors and applications where it is desirable to eliminate the use of solder, such as for wire wrapping, I/O connectors, terminator connectors and the like.

An embodiment of the present invention will now be described by way of example with reference to the accompanying drawings.

DETAILED DESCRIPTION OF THE DRAWINGS

Figure 2:
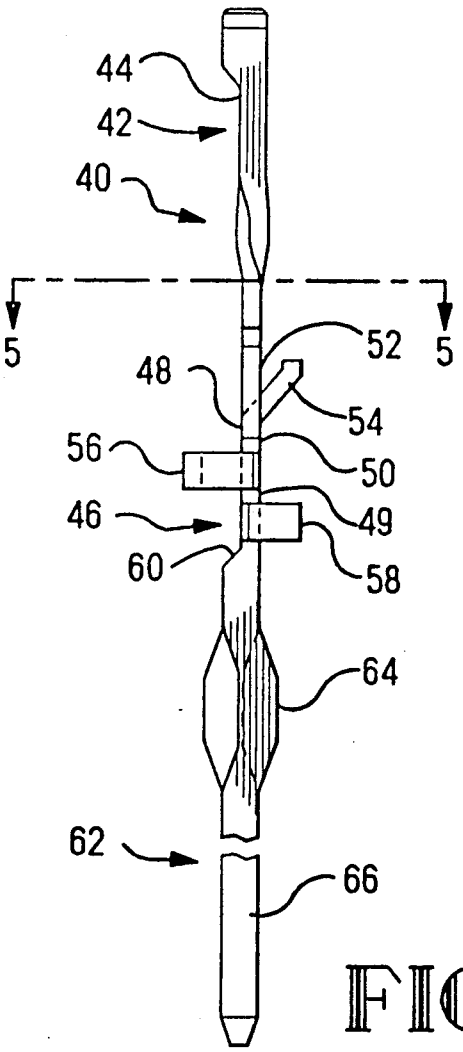
FIG. 2 is a perspective view of the side of the terminal member of the present invention.
Figure 1:
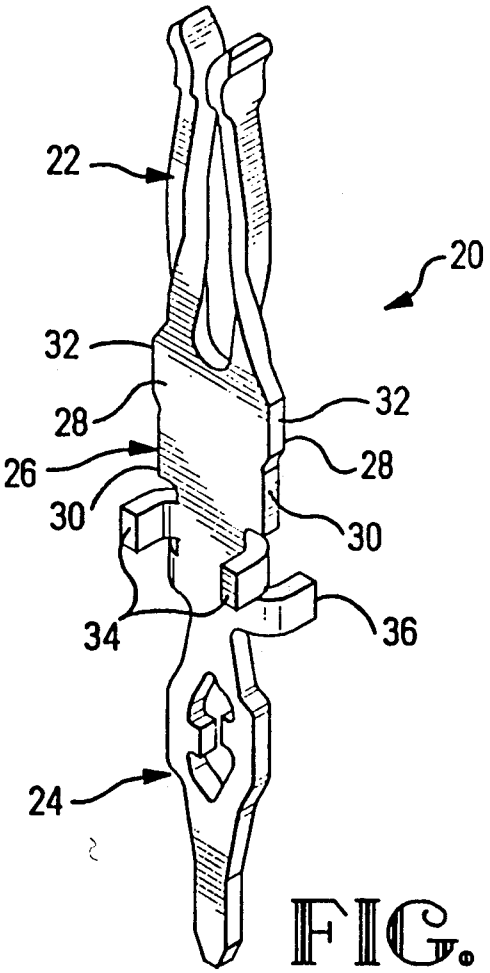
FIG. 1 (PRIOR ART)
FIG. 1 is a perspective view of a prior art terminal.

FIG. 1 shows a stamped and formed prior art terminal 20 having first and second connecting portions 22, 24 and intermediate body portion 26 having opposed faces 28 and opposed side edges 30. Terminal member 20 also includes retention surfaces 32, which extend slightly outwardly along side surfaces 30 and are adapted to cooperate with inner wall surfaces of a connector housing to secure the terminal within the housing. Terminal 20 further includes a first pair 34 of short tabs extending from side edges 30 and bent or formed in the same direction as one of the faces 28. A second pair 36 of short tabs similar to pair 34 extends from opposed side edges 30 and is bent or formed in the same direction as the other of the opposed faces 28. The first and second pairs 34, 36 of short tabs define push surfaces, which cooperate with surfaces within a terminal-receiving cavity of a connector housing. The second connecting portion 24 of the prior art terminal includes a compliant section of the type disclosed in U.S. Pat. No. 4,857,014 and is suitable for stamping and forming from thin stock material.

As can be seen from FIG. 1, terminal member 20 is stamped and formed from a single thickness layer of stock. When an electrical connector having a plurality of terminal members 20 disposed therein is mounted to a circuit board, force is directed along the mating face of the connector and the push ledges within the housing transmit the force to the terminals thereby causing the terminals to be inserted into the circuit board as the connector housing moves into position Terminals of the type shown in FIG. 1 typically require 20 pounds of insertion force per terminal member.

FIGS. 2 through 5 illustrate the terminal member of the present invention. Terminal member 40 has first and second connecting portions 42, 62 and intermediate body portion 46. The first connecting portion comprises a pair of twisted beam contacts 44, which extend forwardly from the body portion and are adapted to receive a mating terminal (not shown) therebetween. The second connecting portion 62 includes a compliant section 64 and a pin portion 66. Compliant section 64 is of the type described in U.S. Pat. No. 4,186,982. Typically this compliant pin terminal requires approximately 40 pounds of axial force to insert the compliant portion 64 into a circuit board through-hole. As can be best seen in FIG. 2, terminal 40 is stamped and formed from a single piece of stock material having different thicknesses at its two ends, 42, 62 with the transition zone identified as 60. The first connecting portion 42 and body portion 46 are stamped and formed from the thinner portion and the second connecting portion 62 including compliant portion 64 is formed from a thicker portion.

Figure 3:
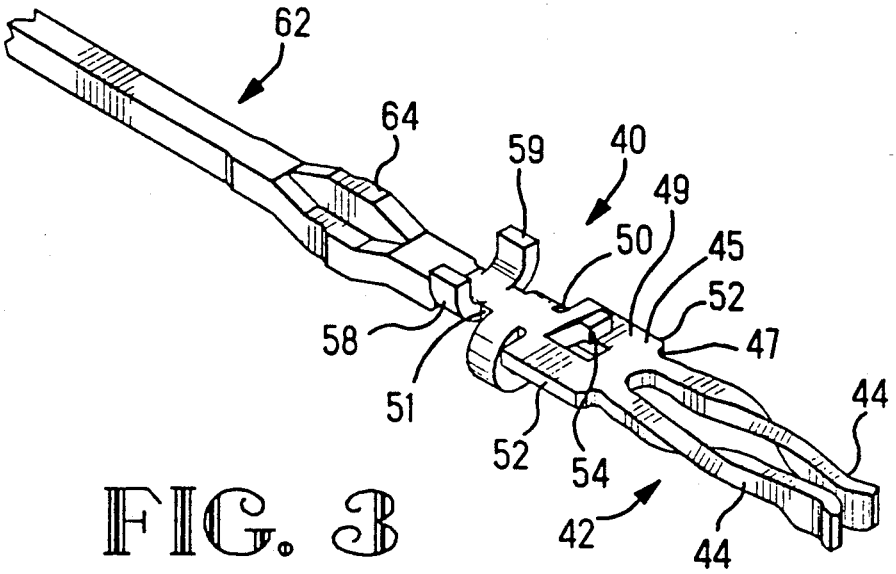
FIG. 3 is a perspective view from the front of the terminal member.
Figure 4:
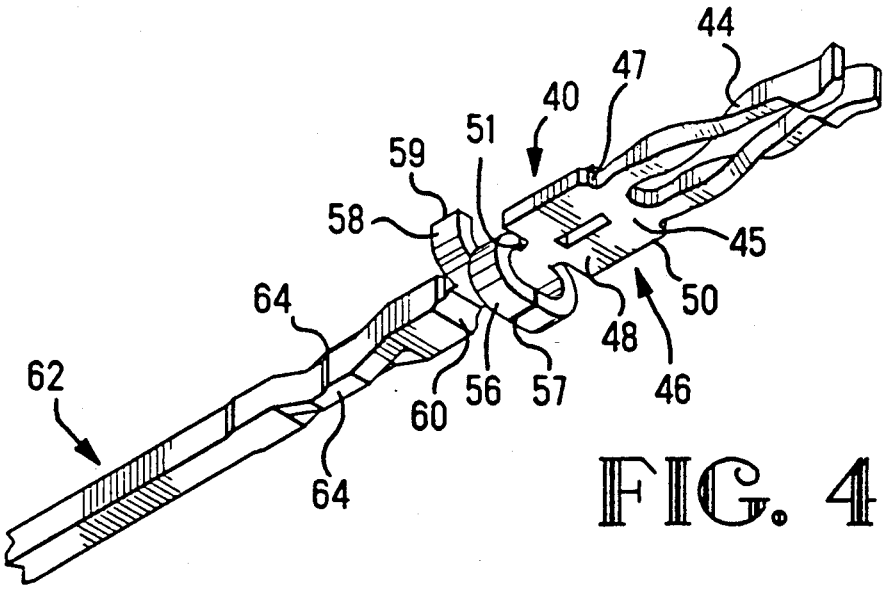
FIG. 4 is a perspective view of the back of the terminal member of FIG. 2.
Figure 5:
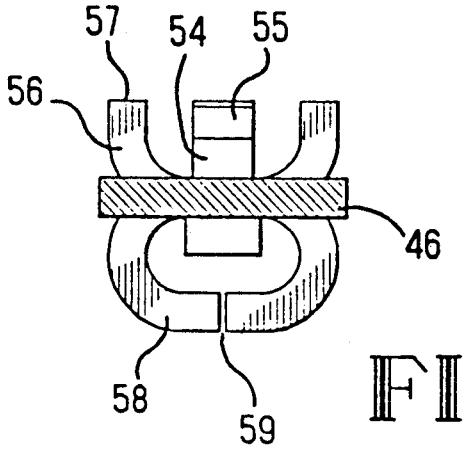
FIG. 5 is a cross section view taken along line 5—5 of FIG. 2.

Referring again to FIGS. 2 through 4, the body portion 46 includes opposed first and second sides 48, 49 and opposed side edges 50, 51. As best seen in FIGS. 3 and 4, intermediate body portion 46 includes a plate-like section 45 having upper stop surface 47, immediately below first contact section 42. Plate-like section 45 has outwardly extending edges 52 defining retaining means and further includes a latch 54 extending outwardly from face 49 and defining a push means at the leading end thereof. A first pair 56 of outwardly directed tabs or arms extend from opposed side edges 50, 51 immediately below the plate section 45. The tabs or arms of first pair 56 are bent toward each other such that the leading ends 57 thereof substantially abut each other proximate to and spaced outwardly from and essentially wrap around side 48 of terminal member 40. A second pair 58 of outwardly directed tabs or arms extend from opposed edges 50, 51 between the first pair 56 of arms and the transition zone 60. The arms of pair 58 are bent or formed to face in the same direction as side 49 of terminal member 40 and are shorter than the corresponding first pair 56 of arms such that the leading ends 59 thereof are spaced from one another. The first and second pairs 56, 58 of arms define second and third push surfaces. As can be seen from FIGS. 2 through 4, push means for the terminal member 40 includes the latch end 54 and the two pairs 56, 58 of arms, which are staggered both horizontally and vertically about the longitudinal axis of the terminal member 40, each of the push surfaces being adapted to cooperate with corresponding ledges within terminal-receiving passageways of a housing as more fully described below. As seen from FIG. 5, which shows the a top view of the terminal member 40 taken along lines 5—5 of FIG. 2, the push surfaces 54, 56 and 58 are defined to distribute the insertion force around the terminal member 40 when it is inserted into a circuit board.

Figure 6:
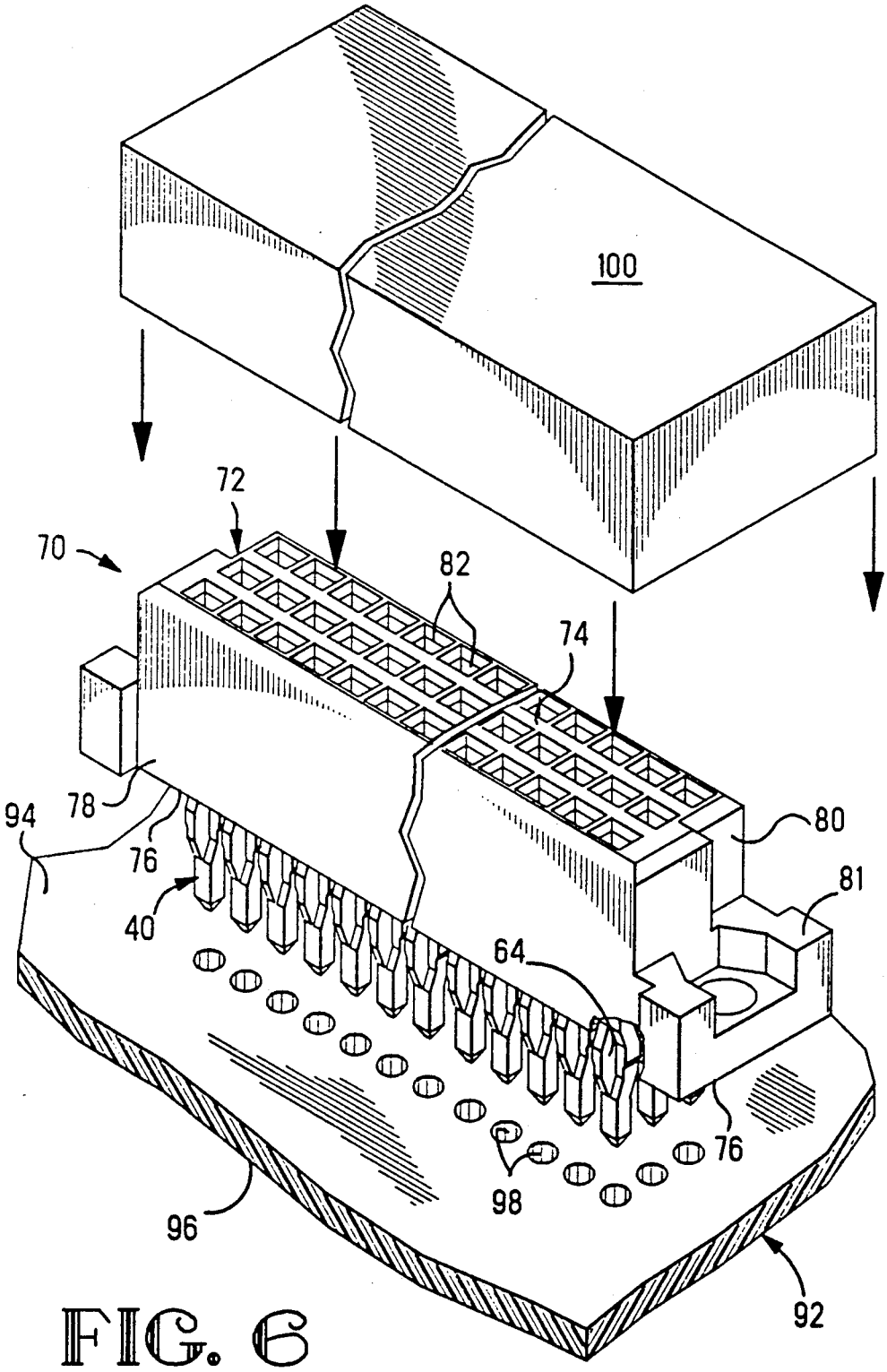
FIG. 6 is a perspective view showing the connector assembly of the present invention being mounted to a circuit board by the "flat rock" method.

FIG. 6 illustrates a connector assembly 70 of the present invention including a housing 72 having a mating face 74, a mounting face 76, opposed sides 78 and opposed ends 80. Connector 70 further includes mounting means 81. Housing 72 further includes a plurality of terminal-receiving passageways 82 extending between the mating and mounting faces 74, 76 and adapted to receive a terminal member 40 in accordance with the present invention. FIG. 6 further illustrates a method of mounting connector assembly 70 to a circuit board 92 by means of a press in a manner known as "flat rock" assembly. For purposes of illustration a portion of the housing has been broken away to show compliant section 64. Circuit board 92 includes opposed surfaces 94, 96 and a plurality of holes 98 extending therebetween for receiving corresponding second connecting portions 62.

Figure 7:
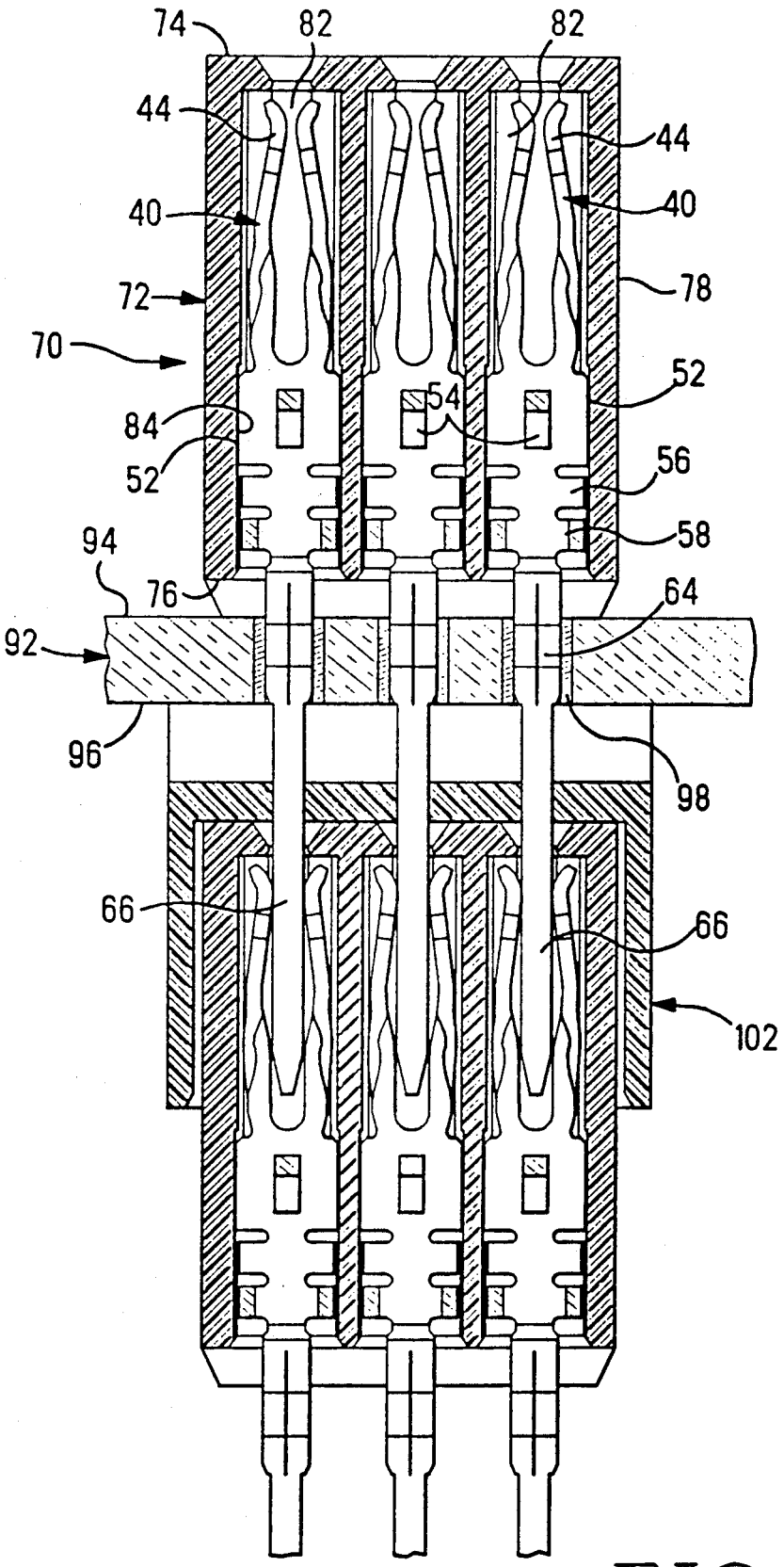
FIG. 7 is a cross sectional view of the connector of FIG. 6 mounted to a circuit board in a stacking configuration and having a second connector mated on the underside of the circuit board.

FIG. 7 is a cross sectional view of connector 70 mounted to a circuit board 92 in a stacked arrangement wherein the second connecting pin portions 66 extend below the circuit board 92 and are received into complimentary contacts of mating terminals shown for purposes of illustration as another connector 70. FIG. 7 also shows the use of a stacking shroud 102, which, as known in the art, is used to facilitate mating and unmating of the stacked connectors by aligning the thicker stock terminal posts 66 that extend below board 92 so that they will be in true position to mate with the thinner and less robust complementary compliant beams 44 of the other connector 70. FIG. 7 further illustrates the compliant pin portion 64 secured within the circuit board.

Figure 10:
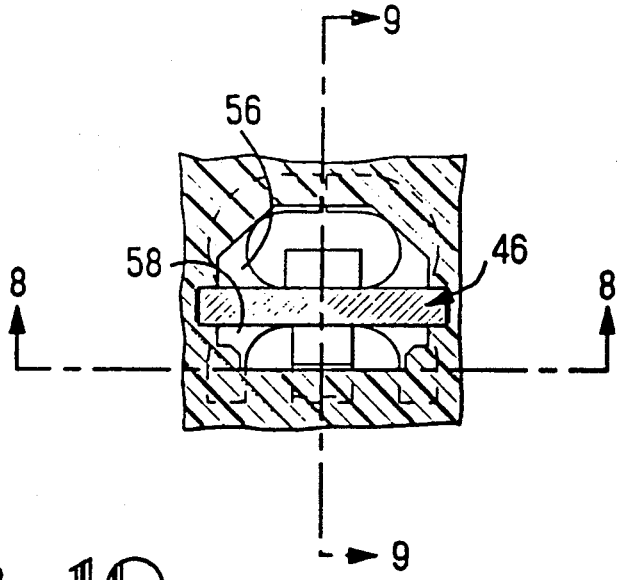
FIG. 10 is a sectional view of the passageway looking down from the mating face of the connector assembly.
Figure 9:
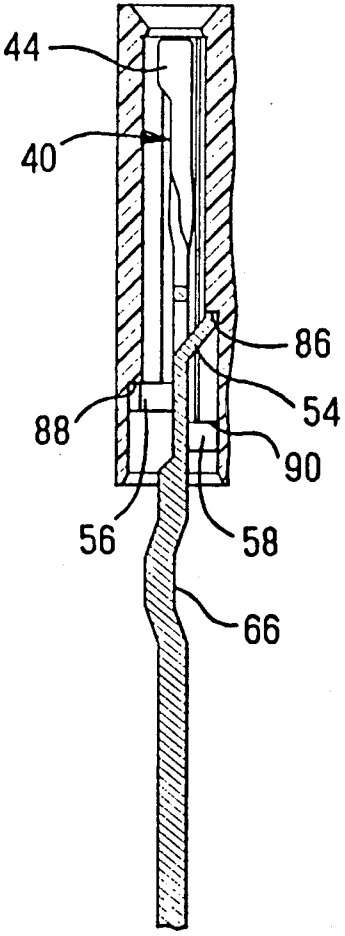
FIG. 9 is an enlarged fragmentary view of the passageway of FIG. 8 and taken at right angles thereto.
Figure 8:
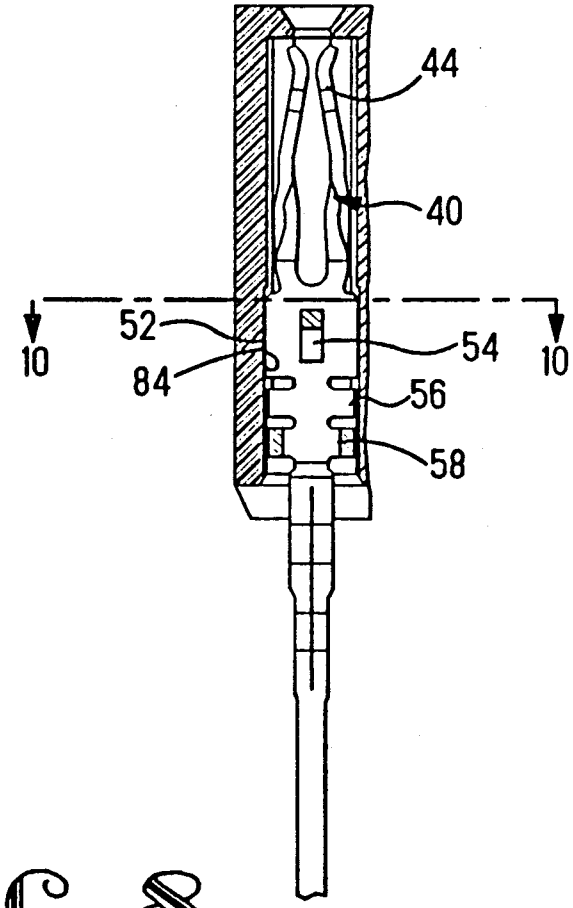
FIG. 8 is an enlarged fragmentary view of a terminal receiving passageway taken across the end of the connector.

In assembling the connector 70 of the present invention, the terminal members 40 are inserted from the mounting face 76 of the housing 72. FIGS. 8 through 10 illustrate the cooperation between various portions of a terminal members 40 with cooperating surfaces and ledges of terminal-receiving passageways 82 in connector housing 72 to secure the terminal members 40 within the housing 72 and to insert the terminal members 40 into a circuit board. Terminal members 40 are pushed into the respective terminal-receiving passageways 82 until the push surfaces 54, 56 and 58 of terminal members 40 engage their respective push ledges 86, 88 and 90 within the terminal-receiving passageway. As the terminal members 40 are moved within the passageways 82, the retention edge surface 52 is frictionally engaged along its sides to retentive surface 84, which secures the terminal member 40 within the passageway 82 and prevents it from falling out of the housing 72. FIG. 10 is a cross sectional view taken along line 10—10 of FIG. 8 and shows the position of the various terminal push surfaces 54, 56, 58 within the terminal-receiving passageway 82, the edges of which are shown in phantom beneath the corresponding passageway push ledges, 86, 88, 90. As can be seen from FIG. 10, approximately the same amount of the push surfaces are covered by the ledges on both sides of the terminal member 40, thus distributing the axial forces essentially in half, with each of the second tabs 58 and latch 54 receiving about an equal amount of the force.

The connector 70 is mounted to the circuit board 92, as shown in FIG. 6, by applying axial force directly to the mating face 74 of housing 72 by means of a press, shown representatively as block 100. The plurality of push surfaces, 54, 56, 58 of the terminal members 40 cooperate with the corresponding push ledges 86, 88, 90 within the terminal-receiving passageway 82 to distribute the force around the terminal members 40 and to force the compliant contact sections 64 of the terminal members 40 to move into the corresponding circuit through-holes 98 of the circuit board 92 without the need of an insertion tool that applies force directly to each individual terminal member.

As previously described this higher retention force associated with the compliant pin terminal of the present invention is sufficient to withstand the mating force directed to the pin portion 66 of the terminal member 40 that extends below the circuit board 92 when connector 70 is used in a stacked relationship.

As can be appreciated from the foregoing description, the present invention provides a terminal member having a compliant pin portion with a substantial retention force and an electrical connector assembly that may be mounted to a circuit board by "flat rock" mounting means. The invention further provides an electrical connector assembly that is suitable for stacking without the need for solder.

It is thought that the electrical terminal member and the connector assembly of the present invention and many of its attendant advantages will be understood form the foregoing description. It is apparent that various changes may be made in the form, construction and arrangement of the parts thereof without departing from the spirit or scope of the invention or sacrificing all of its material advantages.

We claim:

1. A terminal member comprising:

a first contact portion adapted for mating with a complimentary terminal member;

a second contact portion including a compliant section adapted to be received in a through-hole of a circuit board; and an intermediate body portion extending between said first and second contact portions, said body portion being an essentially flat member having first and second opposed sides and opposed edges, said body portion including a plurality of push surfaces adapted to cooperate with corresponding pushing ledges within a connector housing to insert the terminal members into a circuit board, said push surfaces of the body portion being staggered both horizontally and vertically about the longitudinal axis of the terminal member, said push surfaces including a latch extending outwardly from said first side of the body at a first selected axial location, a first pair of outwardly directed tabs extending from opposed side edges of the body portion at a second axially selected location and a second pair of outwardly directed tabs extending from said opposed side edges of the body portion at a third selected axial location, said first pair of tabs being formed toward each other such that leading ends thereof substantially abut each other proximate to and spaced outwardly from said second side of the body section, said second pair of outwardly directed tabs being formed to face in the same direction as the first side of the body portion and the leading ends thereof being spaced from one another, whereby upon disposing said terminal members within respective ones of said terminal-receiving passageways of a connector housing and mounting said connector to the circuit board, force may be applied directly to a mating face of the connector housing whereby the plurality of staggered push surfaces of the terminal members cooperate with corresponding ledges within the terminal-receiving passageways of the housing to distribute the insertion force about the terminal members thereby causing the terminal members and the respective compliant sections to move into the corresponding through-holes into the circuit board without the need of an insertion tool to apply force directly to the individual terminal members.

2. The terminal member of claim 1 wherein at least said first contact portion is made from a thinner layer of stock material than said second contact portion.

3. The terminal member of claim 2 wherein said terminal body portion is also made from said thinner material.

4. The terminal member of claim 1 wherein said second contact portion includes a compliant portion.

5. An electrical connector assembly comprising:

a housing having opposed mating and mounting faces and a plurality of terminal-receiving passageways extending therebetween; and a plurality of terminal members disposed in respective ones of said terminal-receiving passageways, each said terminal member including first and second contact portions and a body portion therebetween with said first contact portion being exposed along said mating face for mating with a corresponding terminal member of a complementary mating connector, said second contact portion extending from the mounting face of the housing and adapted to be secured in a through-hole of a circuit board, and said body portion including retaining means for holding said terminal member within its respective terminal-receiving passageway after insertion therein and a plurality of push means horizontally and vertically staggered about the longitudinal axis of said terminal member and adapted to cooperate with corresponding push ledges within said terminal-receiving passageway to push said terminal member into a corresponding through-hole of a circuit board when said connector is mounted to said circuit board;

said push means including a latch extending outwardly from a first side of said body portion at a first selected axial location, a first pair of outwardly directed tabs extending from opposed second and third sides of said body portion at a second axially selected location, said first pair of tabs being formed toward each other such that leading ends thereof substantially abut each other proximate to and spaced outwardly from a fourth side of said body portion, and a second pair of outwardly directed tabs extending from said second and third sides of said body portion at a third selected axial location, said second pair of tabs being formed to face in the same direction as said first side of said body portion and having leading ends of said tabs spaced from one another, whereby when said connector is mounted to said circuit board by applying force directly to said housing along mating face, said plurality of staggered push means of said terminal members cooperate with said corresponding push surfaces within said terminal-receiving passageways to distribute the force around said terminal members and push said terminal members such that the second terminal contact sections are inserted into respective through holes of said circuit board without the need of an insertion tool that applies force directly to individual terminal members.

6. The connector assembly of claim 5 wherein at least said first contact portion of each of said plurality of terminal members is made from a thinner layer of stock material than said second contact portion.

7. The connector assembly of claim 6 wherein each said terminal body portion is also made from said thinner material.

8. The connector assembly of claim 5 wherein said second contact portion of each of said plurality of terminal members includes a compliant portion.

9. An electrical connector assembly comprising:

a housing having opposed mating and mounting faces and at least one terminal-receiving passageway extending therebetween; and at least one terminal member disposed in said at least one terminal-receiving passageway, said terminal member including first and second contact portions and a body portion therebetween with said first contact portion being exposed along said mating face for mating with a corresponding terminal member of a complementary mating connector, said second contact portion extending from the mounting face of the housing and adapted to be secured in a through-hole of a circuit board, and said body portion including retaining means for holding said terminal member within its respective terminal-receiving passageway after insertion therein and a plurality of push means horizontally and vertically staggered about the longitudinal axis of said terminal member and adapted to cooperate with corresponding push ledges within said terminal-receiving passageway to push said terminal member into a corresponding through-hole of a circuit board when said connector is mounted to said circuit board;

said push means including a latch extending outwardly from a first side of said body portion at a first selected axial location, a first pair of outwardly directed tabs extending from opposed second and third sides of said body portion at a second axially selected location, said first pair of tabs being formed toward each other such that leading ends thereof substantially abut each other proximate to and spaced outwardly from a fourth side of said body portion, and a second pair of outwardly directed tabs extending from said second and third sides of said body portion at a third selected axial location, said second pair of tabs being formed to face in the same direction as said first side of said body portion and having leading ends of said tabs spaced from one another, whereby when said connector is mounted to said circuit board by applying force directly to said housing along mating face, said plurality of staggered push means of said at least one terminal member cooperate with said corresponding push surfaces within said terminal-receiving passageway to distribute the force around said terminal member and push said terminal member such that the second terminal contact section thereof is inserted into a respective through-hole of said circuit board without the need of an insertion tool that applies force directly to the individual terminal member.

10. The connector assembly of claim 9 wherein at least said first contact portion of said terminal member is made from a thinner layer of stock material than said second contact portion.

11. The connector assembly of claim 10 wherein said terminal body portion is also made from said thinner material.

12. The connector assembly of claim 9 wherein said second contact portion of said terminal member includes a compliant portion.

* * * * *